US007627908B1

(12) United States Patent
Pinckney, II

(10) Patent No.: US 7,627,908 B1
(45) Date of Patent: Dec. 8, 2009

(54) REFLECTIVE SURGICAL GOWN

(76) Inventor: James S. Pinckney, II, 2300 Old Spanish Trail, Apt. 1069, Houston, TX (US) 77054

( * ) Notice: Subject to any disclaimer, the term of this patent is extended or adjusted under 35 U.S.C. 154(b) by 0 days.

(21) Appl. No.: 12/144,513

(22) Filed: Jun. 23, 2008

Related U.S. Application Data

(60) Provisional application No. 60/949,907, filed on Jul. 16, 2007.

(51) Int. Cl.
*A41D 13/12* (2006.01)

(52) U.S. Cl. ..... 2/51; 2/69; 2/114

(58) Field of Classification Search ..... 2/51, 2/48, 114, 69, 456, 457, 88, 46, 47, 50, 104, 2/115, 94, 79, 49.1–49.5, 52, 105, 106, 85, 2/77, DIG. 8; 359/518, 516, 517, 519, 879; 128/849, 850, 852
See application file for complete search history.

(56) References Cited

U.S. PATENT DOCUMENTS

| | | | | | |
|---|---|---|---|---|---|
| 291,033 | A * | 1/1884 | Couch | 2/209.13 |
| 883,616 | A * | 3/1908 | Bosworth | 248/470 |
| 3,115,638 | A * | 12/1963 | Kikas | 2/48 |
| 3,691,564 | A * | 9/1972 | La Marre et al. | 2/458 |
| 3,727,236 | A * | 4/1973 | Lloyd et al. | 2/51 |
| 4,660,225 | A * | 4/1987 | Kahn | 2/49.4 |
| 4,710,979 | A * | 12/1987 | Bull et al. | 2/48 |
| 4,765,323 | A * | 8/1988 | Poettgen | 128/849 |
| 4,863,239 | A * | 9/1989 | Malone | 359/879 |
| 5,225,236 | A * | 7/1993 | Keusch et al. | 128/849 |
| 5,285,312 | A * | 2/1994 | Mastro | 359/516 |
| 5,309,925 | A * | 5/1994 | Policastro | 128/849 |
| 5,461,724 | A * | 10/1995 | Wiedner et al. | 2/457 |
| 5,673,433 | A * | 10/1997 | Rothrum | 2/46 |
| 5,829,056 | A * | 11/1998 | Hubert | 2/48 |
| 6,354,708 | B1 * | 3/2002 | Monahan et al. | 359/871 |
| 6,910,931 | B1 * | 6/2005 | Nakase | 441/106 |
| 7,048,160 | B2 * | 5/2006 | Anderson | 2/48 |
| 2005/0280536 | A1 * | 12/2005 | Hamilton et al. | 340/572.1 |

* cited by examiner

*Primary Examiner*—Amy B Vanatta
(74) *Attorney, Agent, or Firm*—Egbert Law Offices PLLC

(57) ABSTRACT

A reflective surgical gown has a surgical gown, and a reflector affixed to the surgical gown for reflecting light and images. The reflector is removably affixed to the surgical gown. The reflector can be a flexible panel that has an adhesive surface positioned between the flexible panel and the surgical gown. The flexible panel is flexible. The flexible panel is formed a material suitable for producing a mirror effect. The flexible panel has a matte finish. The flexible panel is sterile. The adhesive surface is sterile. The reflector is positioned on an upper portion of the front side of the surgical gown. The flexible panel can also be threadedly affixed to the surgical gown. A tracking device can be positioned adjacent the reflector.

9 Claims, 3 Drawing Sheets

REFLECTIVE SURGICAL GOWN

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to surgical gowns. More particularly, the present invention the relates to surgical gowns having reflective surfaces affixed thereto.

2. Description of Related Art Including Information Disclosed Under 37 CFR 1.97 and 37 CFR 1.98.

In today's world, mirrors are utilized for hundreds of different applications. Though applications may differ vastly, the purpose of a mirror is to view an object that is not easily visible without the aid of a reflective surface. Another purpose of a mirror is to reflect light onto a surface that would otherwise lack light. The vast majority of mirrors are composed of glass making them heavy, fragile, and increasingly more difficult to transport as they become larger in size.

In modern surgical procedures, surgeons create the smallest incision possible to successfully complete a given procedure. Small incisions are made for many reasons, including to decrease post-operative complications and to enhance patient recovery time.

Smaller incisions are, of course, beneficial to the patient. However, the utilization of smaller incisions has created a visibility problem in the operating room. For example, a surgeon that performs a procedure is placed in an optimal position for visibility and access to the surgical site, i.e. surgical field. While the surgeon is in an optimal position for performing the procedure, other operating room personnel, such as the first assistant, surgical technician, medical students, anaesthesiologist, and/or circulator are left with less than optimal positions to view the surgical site.

Another problem associated with making small incisions is that medical students and residents who routinely prepare for surgeries in order to learn and gain experience are often unable to view the surgical site. The inability of medical students and residents to see a particular surgery at the surgery site defeats the purpose of preparing for and attending the surgical procedure and drastically inhibits their learning experiences. Thus, there is a need to increase the visibility of surgical sites for persons taking part in or observing a surgery or medical procedure.

Various patents have issued relating to reflective materials placed on garments. For example, U.S. Pat. No. 5,285,312, issued on Feb. 8, 1994 to Mastro, discloses a flexible film of plastic material, such as "Mylar", coated with metal to provide a mirror surface. The flexible film can be sewn onto a normally obscured portion of apparel, such as a necktie, to provide a discreet mirror. Alternatively, the mirror-film can be affixed to the apparel by a cement or by "Velcro". The Velcro would have hooks and loops that would extend in an extension of clothing.

U.S. Pat. No. 6,773,807, issued on Aug. 10, 2004 to Landberg et al., discloses an apparatus for conveying information and a method of using the apparatus during a medical emergency. The apparatus consists of a perforated adhesive tape with a front side and a back side. The back side includes an adhesive applied thereto to enable the tape to be affixed to a secondary surface. The front side includes borders on each side thereof. The borders are comprised of a reflective material. The tape can be attached to clothing. The reflective material enables the tape to become visible in low light environments.

U.S. Pat. No. 4,863,239, issued on Sep. 5, 1989 to Malone, discloses a rear-view mirror adapted for use upon the back portion of a glove. The device combines the safety features of a rear-view mirror with the manipulative and traditional features of a worn glove.

U.S. Pat. No. 3,849,804, issued on Nov. 26, 1974 to Rakow, discloses a light reflective material that is applied directly to a localized area on the inner side of a trouser leg, coat sleeve or skirt so that the garment may be turned up to form a temporary cuff that exposes the light reflective material while walking in the dark so as to warn the driving of a moving vehicle having headlights of the presence of the wearer in or near the path of the vehicle. In the normal use of the garment, i.e., with the cuff turned down, the light reflective material is concealed from view. When the light reflective material is placed on a coat, it is placed under the collar so that when the collar is turned down the coat looks normal, and when the collar is turned up, the light reflective material is exposed.

It is an object of the present invention to provide a surgical gown with a portable, durable, and light-weight mirror that will not shatter upon contact with a hard surface.

It is another object of the present invention to provide to a surgical gown that can be used where any reflective surface is needed, i.e., dance studios, the walls of workout facilities, homes, dormitory rooms, commercial buildings, the inside of lockers, compact store and handbags, in the fashion industry, backstage at concerts and runway shows, intersections of corridors/hallways, and automobiles side-view mirrors.

It is another object of the present invention to provide a surgical gown that allows non-sterile personnel to visualize a surgical procedure without contaminating the surgical site in an operating room.

It is still another object of the present invention to provide a surgical gown that decreases the patient's risk of infection.

It is another object of the present invention to provide a surgical gown that allows medical students and residents to have unobstructed views of the surgical site.

It is another object of the present invention to provide a surgical gown that improves the safety of a surgical procedure by increasing visibility.

It is another object of the present invention to provide a surgical gown that allows a first assistant or surgical technician to accurately visualize the area of the operative field and anticipate the next step of the procedure so as to increase the efficiency of the operation by reducing procedure time.

It is still another object of the present invention to provide a surgical gown that increases visualization of the operative field and allows anaesthesiologist to estimate the progression of the procedure and thereby decrease the interruptions of the surgeon that tend to break the surgeon's concentration, ultimately decreasing surgical complications.

It is another object of the present invention to provide a surgical gown that quickens surgical procedures.

It is another object of the present invention to provide a surgical gown that decreases costs to the hospital.

It is another object of the present invention to provide a surgical gown that reduces the number of adjustments of overhead lights in an operating room, subsequently reducing the time for the surgical procedure as well as complications by allowing the surgery to be performed more fluidly.

These and other objects and advantages of the present invention will become apparent from a reading of the attached specification and appended claims.

BRIEF SUMMARY OF THE INVENTION

The present invention is a reflective surgical gown comprising a surgical gown, and a reflecting means affixed to the surgical gown for reflecting light and images. The reflecting means is removably affixed to the surgical gown. The reflecting means comprises a flexible panel, and an adhesive surface positioned between the flexible panel and the surgical gown. The flexible panel is flexible. The flexible panel is formed a material suitable for producing a mirror effect. The flexible panel has a matte finish. The flexible panel is sterile. The adhesive surface is sterile. The reflecting means is positioned on an upper portion of the front side of the surgical gown. The flexible panel can also be threadedly affixed to the surgical gown. A tracking device can be positioned adjacent the reflecting means.

DETAILED DESCRIPTION OF THE INVENTION

Figure 1:
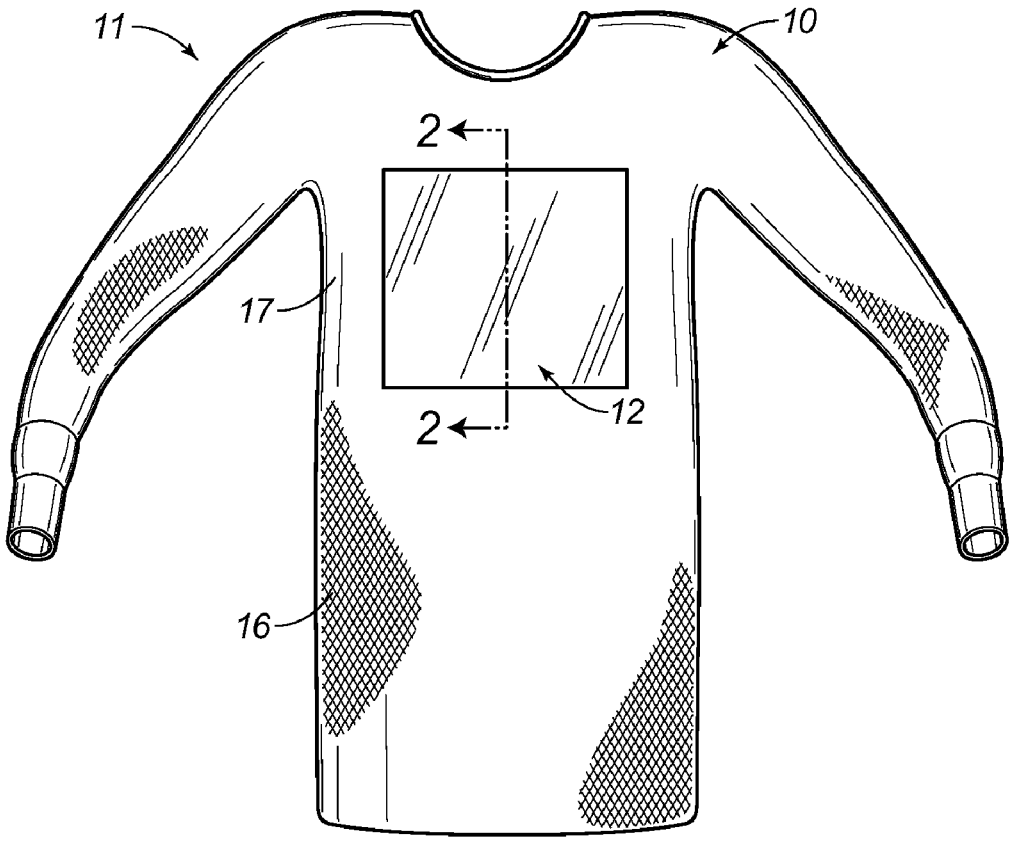
FIG. 1 shows a front elevational view of the preferred embodiment of the reflective surgical gown of the present invention.

Referring to FIG. 1, there is shown a front elevational view of the preferred embodiment of the reflective surgical gown 11 of the present invention. The reflective surgical gown 11 has a surgical gown 10 and a reflecting means affixed thereto. The reflecting means is a flexible panel 12 in the preferred embodiment. Surgical gown 10 may either be a disposable or a reusable gown. The flexible panel 12 is flexible and portable. The flexible panel 12 is affixed to the upper portion 17 of the front side 16 of the surgical gown 10. The flexible panel 12 can be formed of any material suitable for producing a mirror affect. Additionally, the flexible panel 12 must be made of a material suitable for sterilization. The flexible panel 12 may have a matte finish which would tend to reduce any glare. A light can be shown on the flexible panel 12 so that flexible panel 12 reflects light onto the surgical site, or surgical field. Additionally, video recording devices can capture images reflected from the flexible panel 12 and transmit those images to remote location for viewing by persons such as medical students and residents.

The flexible panel 12 is relatively portable in that it does not obstruct any movement of a surgeon wearing the reflective surgical gown 11 of the present invention. The flexible panel 12 is also flexible and will move with the movement of a surgeon. The flexible panel 12 can be of any size and shape suitable for reflecting light and images. The present invention contemplates that the flexible panel 12 can be placed in other locations on the surgical gown 10 that provide optimal visibility of the surgical field. The flexible panel 12 may be formed of aluminum foil, aluminum film, a reflective plastic sheet, a reflective plastic cloth, aluminized fabric, or any other material that would produce a mirror effect. Suitable fabrics include Gentex™ dual-mirror aluminized fabrics, Mylar reflective film, reflective polyester film, metalized polyester film, aluminized glass fiber insulating tape, and aluminized nylon and polyethylene barrier film.

Figure 2:
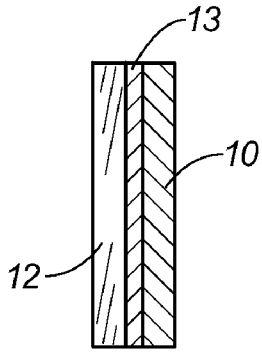
FIG. 2 shows a cross-sectional view of the reflective surgical gown of the present invention taken along sight line 2-2 of FIG. 1.

Referring to FIG. 2, there is shown a cross-sectional view of the reflective surgical gown 11 of the present invention taken along sight line 2-2 of FIG. 1. An adhesive surface 13 is positioned between the flexible panel 12 and the surgical gown 10. The adhesive surface 13 may be composed of any type of glue (permanent or non-permanent), adhesive chemical that can adhere to a surface more than once so that the flexible panel 12 can be moved from surface to surface, a magnet in order for the flexible panel 12 to easily adhere to metal surfaces, or tape.

Figure 3:
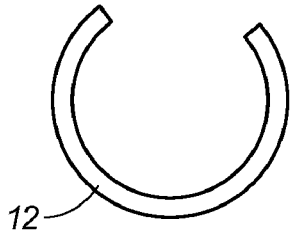
FIG. 3 shows a side elevational view of the reflective means of the present invention in a rolled position.

Referring to FIG. 3, there is shown a side elevational view of the reflecting means of the present invention in a rolled position. In the preferred embodiment, the reflecting means is a flexible panel 12. As can be seen, the flexible panel 12 is flexible and can be rolled in a manner so as to make the flexible panel 12 portable for transport in a cylindrical tube or rectangular container. The flexible panel 12 thus is portable, durable, light-weight, and will not shatter upon contact with hard surfaces. The flexible panel 12 is made of a material that can be easily sterilized.

Figure 4:
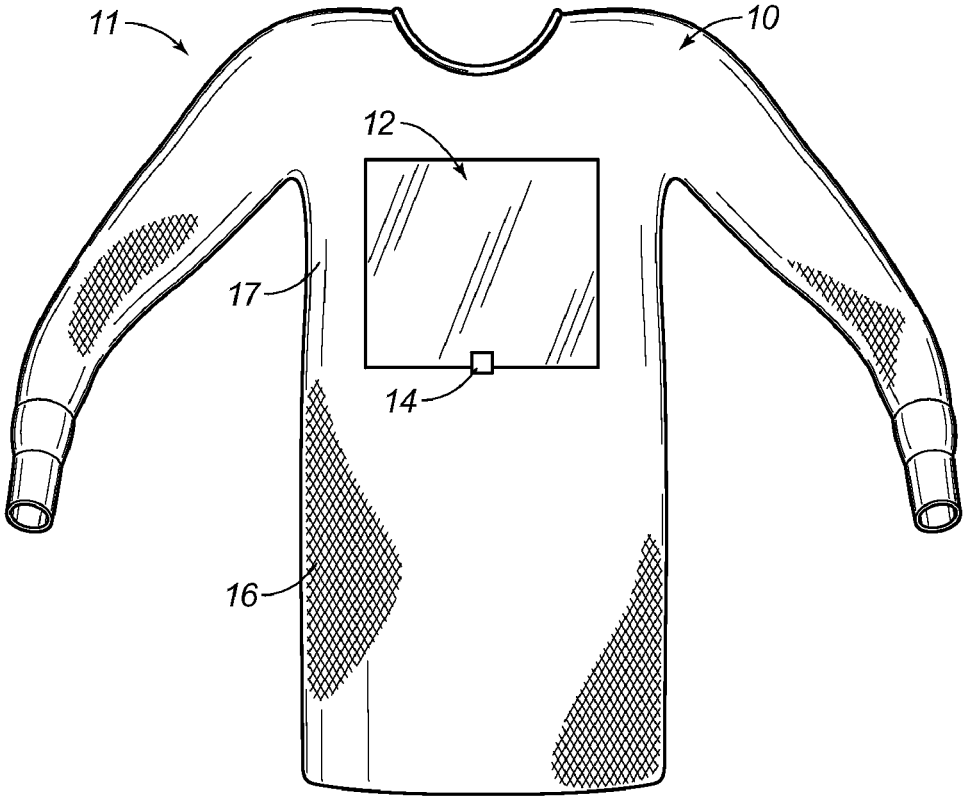
FIG. 4 shows a front elevational view of the preferred embodiment of the reflective surgical gown of the present invention, with a tracking device attached thereto.

Referring to FIG. 4, there is shown a front elevational view of the reflective surgical gown 11 of the present invention, with a tracking device 14. The tracking device 14 is positioned adjacent the flexible panel 12. The tracking device 14 can be placed at any suitable location for tracking the position of the flexible panel 12 on the surgical gown 10. The tracking device 14 can be synchronized with a video recording device so that the video recording device automatically follows the position of the flexible panel 12. Thus, a video can be transmitted to a PDA, handheld receiver, or other remote location allowing medical students, residents, and other surgeons to view the surgery without entering the surgical site, or surgical field. At the same time, a light can be reflected from the flexible panel 12 onto the surgical site so as to illuminate the surgical site and provide an enhanced image for recording by the video recording device. Thus, observers of a surgical procedure can be in any location remote to the operating room.

Figure 5:
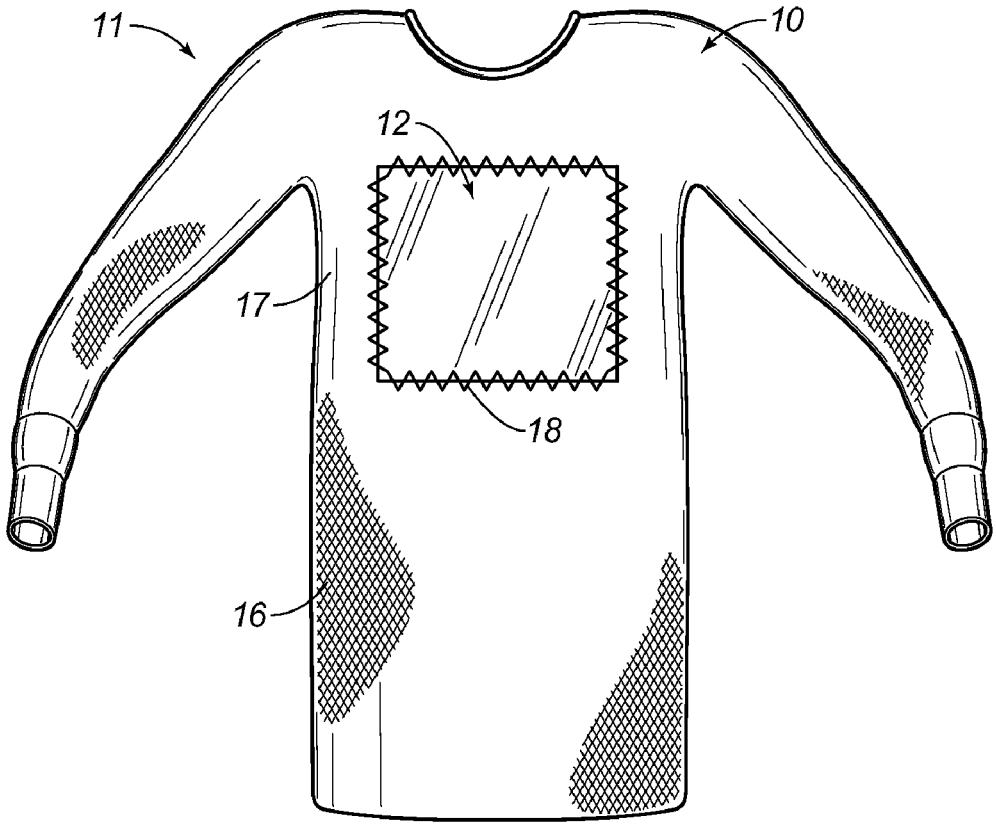
FIG. 5 shows a front elevational view of the reflective surgical gown of the present invention, with the reflective means sewn to the surgical gown.

Referring to FIG. 5, there is shown a front elevational view of the reflective surgical gown 11 of the present invention, with the flexible panel 12 threadedly attached to the surgical gown 10. The flexible panel 12 is again attached to the upper portion 17 of the front side 16 of the surgical gown 10. The present invention contemplates that the flexible panel 12 does not necessarily have to be affixed to the surgical gown 10 by an adhesive surface. That is, the back side of the flexible panel 12 may be smooth and non-adhesive. FIG. 5 shows the flexible panel 12 as sewn to the surgical gown 10. Other forms of attachment of the flexible panel 12 to the surgical gown 10 are entirely possible and are contemplated by the present invention.

Figure 6:
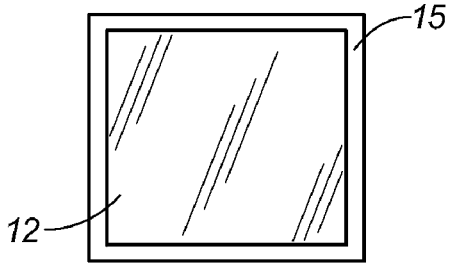
FIG. 6 shows a front elevational view of the reflective means supported by a frame.

Referring to FIG. 6, there is shown a front elevational view of the flexible panel 12 of the present invention mounted to a frame 15. In the event that the flexible panel 12 is too flexible for viewing images or reflecting light from the front side 16 of the surgical gown 10, the present invention contemplates that the flexible panel 12 can be mounted to a frame 15 so as to create a rigid reflecting means. Like the flexible panel 12, the frame can be fashioned into any shape or size and composed of any material suitable for making the flexible panel 12 more rigid, such as wood, plastic, or metal.

The foregoing disclosure and description of the invention is illustrative and explanatory thereof. Various changes in the details of the illustrated construction can be made within the scope of the present claims without departing from the true spirit of the invention. The present invention should only be limited by the following claims and their legal equivalents.

I claim:

1. A reflective surgical gown comprising:

a surgical gown; and a reflecting means attached directly to a portion of a surface of said surgical gown for reflecting light and images in a planar mirror image reflecting manner.

2. The reflective surgical gown of claim 1, said reflecting means being removably affixed to said surgical gown.

3. The reflective surgical gown of claim 1, said reflecting means comprising:

a flexible panel being formed of a material suitable for producing an exact undistorted mirror image.

4. The reflective surgical gown of claim 3, said reflecting means further comprising:

an adhesive surface positioned between said flexible panel and said surgical gown.

5. The reflective surgical gown of claim 1, said reflecting means being threadedly affixed to said surgical gown.

6. The reflective surgical gown of claim 1, said portion of the surface of said surgical gown being positioned on an upper portion of a front side of said surgical gown.

7. A reflective surgical gown comprising:

a surgical gown; and a reflecting means attached directly to said surgical gown for reflecting light and images in an undistorted planar mirror manner, said reflecting means being positioned only on an upper portion of a front side of said surgical gown so as to provide visualization of a surgical field by person other than a person wearing said surgical gown.

8. The reflective surgical gown of claim 7, said reflecting means comprising:

a flexible panel formed a material suitable for producing a reflection of images in the undistorted planar mirror manner.

9. The reflective surgical gown of claim 8, said reflecting means further comprising:

an adhesive surface positioned between said flexible panel and said surgical gown.

* * * * *